United States Patent [19]

Dishner, Jr.

[11] 4,426,083

[45] Jan. 17, 1984

[54] PUTTER

[76] Inventor: William C. Dishner, Jr., P.O. Box 1387, Marco Island, Fla. 33937

[21] Appl. No.: 350,202

[22] Filed: Feb. 19, 1982

[51] Int. Cl.[3] ..... A63B 53/04; A63B 53/14

[52] U.S. Cl. ..... 273/164; 273/168; 273/81 B

[58] Field of Search ..... 273/81.3, 81 B, 80 C, 273/164, 163 R, 163 A, 167 K, 167 G, 167 F, 168, 167 D; D21/216-221

[56] References Cited

U.S. PATENT DOCUMENTS

| | | | |
|---|---|---|---|
| 837,030 | 11/1906 | Blanchard | 273/81 B X |
| 2,478,468 | 8/1949 | Drake | 273/80 C |
| 3,219,348 | 11/1965 | Dishner | 273/80 C |
| 3,574,349 | 4/1971 | Kropp | 273/80 C |

OTHER PUBLICATIONS

"The Washington Star", Jun. 10, 1977, p. E-2.
"Golf Digest", Apr. 1980, p. 146.

*Primary Examiner*—George J. Marlo
*Attorney, Agent, or Firm*—Miller, Morriss & Pappas

[57] ABSTRACT

A putter for playing golf having a club head that is symmetrical on each side of a central stem and having a handle which extends between about 10 degrees and 15 degrees from vertical as presented by the stem. The top of the club head carries sighting or aiming indicia and the handle extends down the shaft for a length in excess of half of the height of the putter or golf club. The sighting indicia is parallel and spaced-apart the distance of about the diameter of a golf ball on the top surface of the putter so that in aligning shots the lines of sight over the ball converge on the target and bracket the ball.

6 Claims, 9 Drawing Figures

PUTTER

The present invention is directed to a putter type golf club and more particularly to a putter having a shaft which rises vertically from the center of the club head between the two spaced-apart substantially vertical planes formed by the symmetrical club faces, and then the shaft bends slightly in a plane substantially parallel to the planes of the club faces. The shaft continues upwardly and is terminally connected to an elongate handle which handle extends downward for a length in excess of one-half of the length of the club. Truncations in the upper portion of the club head are symmetrical on each side of the stem extension and form lines transverse of the planes of the club faces and which lines are spaced-apart a distance substantially equal to the diameter of a golf ball.

In putters it is quite usual to accommodate a stem and shaft which rises from the club head at an angle from vertical formed by the stem portion of the club and thereafter the shaft is straight. In the present invention the stem rises vertically and then the stem is fashioned to socket the shaft at an angle accommodating usual and conventional side facing putting styles and also to allow the putter to be used in the manner of a croquet mallet where one hand provides a fulcrum and the other hand of a putting player is gripped higher on the handle to manipulate the handle extension as a lever. In this latter style of putting, the user faces forward and the selected angle postures the putter face to the side of the feet of the person putting. The present invention is suited to both styles of putting and to both left and right handed players without special modification of the club.

The closest known prior art is found in my earlier U.S. Pat. No. 3,219,348 in which a triangularly cross sectioned handle was provided to facilitate a palm-to-palm overlapping grip and in that structure the putter shaft and handle deviated two degrees to eight degrees from the vertically rising stem or from a vertical line rising through the stem or shaft at the center of the club head.

The intent of the present invention is to provide a putter construction which is adaptable to the full range of putting styles while providing optimum and comfortable "feel" by the user.

Another object is to provide a club head construction in which sighting toward the target of the hole in play is possible over the ball and the ball is bracketed and centered between parallel sight lines visible to the player over the shaft.

Still another object is to provide a symmetrically balanced club accommodating the placement of the mass of the club head immediately behind the impact point of ball to face and in-line with the stem.

GENERAL DESCRIPTION

In general, the golf club of the present invention is a putter used to strike a golf ball on a uniformly cropped putting green and wherein the faces of the club at impact with the ball have zero or very minimal loft or angle. The face is vertical at impact and is arranged to bracket the ball between parallel aiming indicia which, projected, bracket the hole of the putting target except as corrections are required for rolling or canted terrain, windage and the like. The club head has a pair of spaced-apart integral planar vertical faces. The sole of the club is in a horizontal plane transverse to the faces and the sole plate is rounded at either end. This results in a club-head symmetry which is accentuated by truncations on the upper surface of the club head which meet the horizontal upper place in a pair of spaced-apart lines on either side of a vertically rising stem. The stem is terminally provided at its upper end with a slight bend (between about 10 degrees from vertical to about 15 degrees from vertical). In this manner the stem sockets a straight shaft which rises at the selected angle from the vertical portion of the stem. A handle is then secured to the shaft and the handle is on the upper end connected to the shaft and coaxially covers and extends along the shaft a distance in excess of one-half the total length of the club. The handle is elongate and is provided with fore and aft flats. This arrangement of flats in the handle achieves proper hand support whether the hands are used in an adjacent connected grip or in a spaced-apart grip. The length of the handle accommodates players using an extreme crouch or a fairly erect posture in addressing the ball.

IN THE DRAWINGS

SPECIFIC DESCRIPTION

Figure 1:
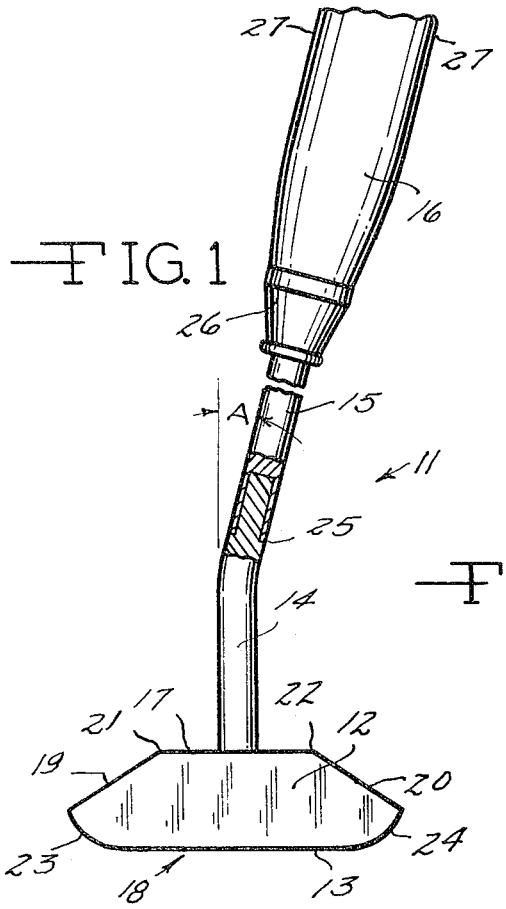
FIG. 1 is a side elevation view of the putter of the present invention with the shaft broken away but showing the lower connection of handle to shaft and the connection of the shaft to stem.
Figure 2:
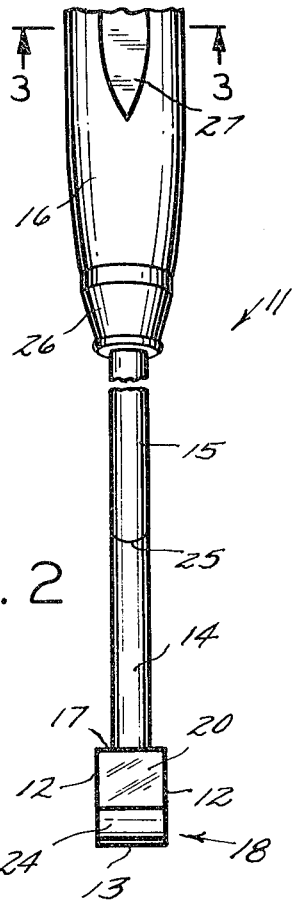
FIG. 2 is a front elevation view of the putter shown in FIG. 1.

Referring to the drawing and with first specific reference to the FIG. 1 thereof, the golf club or putter 11 of the present invention is indicated with one of the two parallel spaced-apart impact faces 12 directed toward the viewer and positioned with the sole or bottom 13 in horizontal use relation and with the stem 14 connected to the shaft 15 so that the shaft 15 and handle 16 are at an angle deviating from vertical between about 10 degrees and 15 degrees. The angle A indicates the deviation from vertical. The top 17 of the club head 18 is in a plane transverse to the axis of the stem 14 and the truncations 19 and 20 at each end of the club head 18 intersect the plane of the top 17 and the planar extension of the sole 13. The planes of the truncations 19 and 20 are perpendicular to the parallel faces 12 so that at the top 17 of the club head 18 the intersection of the truncations 19 and 20 and the top 17 form parallel spaced-apart indicia or sighting lines or guides 21 and 22 easily visible from above the club head 18 and symmetrical in respect to the stem 14. The lines or guides 21 and 22 are spaced-apart by about the diameter of a golf ball and hence form with the ball, in use, a ready and integral direction indicator or sight which assists the player in aligning the stroke and in following through as the stroke is executed. The ends 23 and 24 of the sole 13 are curved tangentially upward to abrupt intersection with the truncations 19 and 20, respectively. This forms a symmetric relief for the sole 13 in prevention of excessive drag of the sole 13 where angular waver is experienced in the stroke. The connection 25 of shaft 15 to stem 14 is smooth and swaged or otherwise attached or socketed in prevention of either part turning independently of the other. For appearances, the joint of connection 25 may be trimmed by a suitable cover sleeve, not shown. As shown in the preferred embodiment, the stem 14 is integrally formed with the club head 18. The stem 14 may also be separately manufactured and attached to the club head 19 as by threaded means, brazing, welding or other physical attachment. It has been suggested that the shaft 15 may be bent to serve as the stem 14 and in such instances the shaft 15 would be connected directly to the club head 18. Since the diameter of the handle 16 is substantially greater than the diameter of shaft 15, a ferrule 26 serves to trim the lower end of the handle 16 to the shaft 15 and, since the handle 16 is preferred to be constructed of wood, the ferrule 25 enhances appearance and provides a smooth transition at the juncture of shaft 15 to handle 16. Flats 27 are provided on two sides, upper and lower, of the handle 16 and this is seen in FIG. 2. In FIG. 2 the symmetry of the shaft 15, handle 16, stem 14, and club head 18 is best appreciated and the axis of handle 16 and shaft 15 is seen in a plane between the parallel vertical planes of the impact faces 12.

Figure 3:
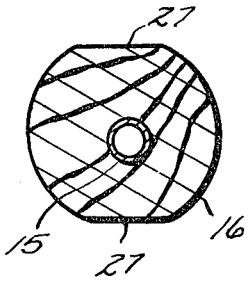
FIG. 3 is a cross section plan view taken on the line 3—3 of FIG. 2 and especially indicating the fore and aft elongate flats on the handle.

FIG. 3 best expresses the fore and aft or upper and lower flats 27 on the handle 16 and the handle 16 is axially supported on the shaft 15. These flats 27 provide hand and finger orienting planes for tactile guidance for the grip stroke and follow-through.

Figure 4:
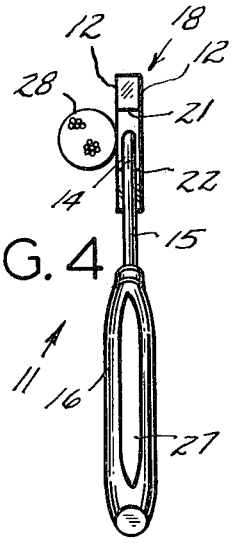
FIG. 4 is a top plan view of the putter of the present invention as seen addressing a golf ball.

In FIG. 4 the putter 11 is viewed from above and the putter 11 addresses the golf ball 28 and the two lines 21 and 22 are aligned to visually bracket the ball 28 as those lines are mentally projected by the player framing the line of sight. The handle 16 is also seen as more elongate than the handles of other putters since the handle 16 of the putter 11 extends for more than one-half of the height of the club 11. This facilitates universal use of the club 11 in low-high separation of the hands as in croquet-like usage and in overlapping conventional grips, high or low, on the shaft or handle.

Figure 5:
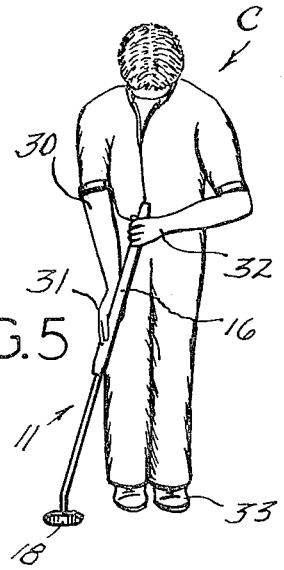
FIG. 5 is a side elevation view of the putter of the present invention in which one hand is low on the handle and the other hand is high and the player is using an offset address where the feet and body face forwardly and the ball is located to the side of the feet and body.

The FIGS. 5, 5A and 6, 6A dramatize the variances of usage and grip of the club 11. In FIG. 5 a player C is using the putter 11 in a croquet-like offset grip. The right arm 30 is posting and forms a fulcrum of the hand 31 low on the club 11 that steadies and aligns the club head 18 so that one of the impact faces 12 is perpendicular to the line of sight. The other or left hand 32, as shown, grasps the club 11 near the upper end of the handle 16. One hand posts and the other hand moves to assure a guided impact and proper follow-through. It should be appreciated that either hand can post and whatever hand posts the other then moves the end of the handle on the fulcrum to achieve pushing of the ball in an accurate and effective manner.

Figure 5A:
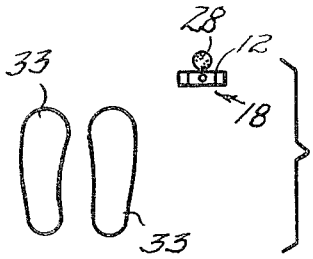
FIG. 5A is a somewhat schematic diagram showing foot and ball to club face placement as seen in FIG. 5.
Figure 6A:
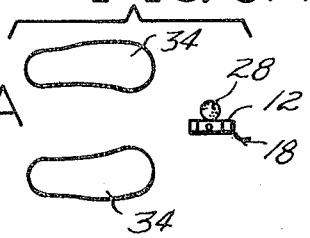
FIG. 6A is a somewhat schematic diagram showing foot and ball to club face placement of the player as in FIG. 6.

In FIG. 5A the stance of the player C is visually indicated by the position of the feet 33, the position of the ball 28, club head 18, and the guide lines 21 and 22 formed by the truncations as previously indicated.

Figure 6:
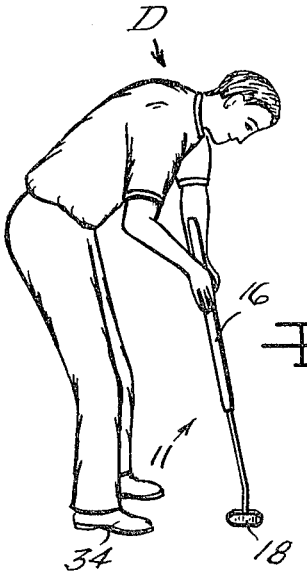
FIG. 6 is a side elevation view of a conventional use of the putter where the player hunches over the ball with eyes substantially directed over the ball in addressing the ball.

In FIG. 6 a more conventional hunched position is shown in respect to the player D using the club 11. Here the eyes of the player D are substantially directly over the club head 18 and a close connected or overlapping grip is illustrated. Palm-to-palm handling is also possible in the manner of a style of putting developed by me. Here the length of the handle 16 adapts the club to a wide variance of personal stances and physiognomy. Here the stroke is more pendulum-like and the average or usual address of the ball 28 is seen in the FIG. 6A in respect to the positioning of the feet 34 with the ball 28 located usually between and spaced away from the feet 34 to accommodate the posturing of the eyes above the ball 28.

Figure 7:
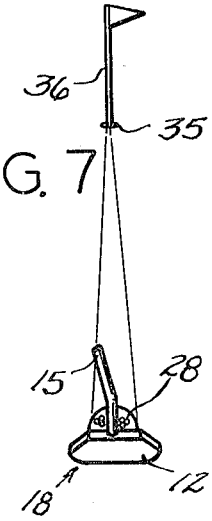
FIG. 7 is a perspective view from the side of the putter not contacting the ball and using the truncations as intersecting the top of the club head as alignment sights bracketing the ball and remote hole and indicating the bracketing by the indicated sight rays.

In FIG. 7 the aiming feature using the lines 21 and 22 sighted over or bracketing the ball 28 provides a very necessary sight indicia to the hole 35 in which the flag or pin 36 is seen. The rays over the ball 28 visually converge on the pin 36 used as the target. This visual projection enhances targeting and is useful, as well, in accommodating variances in slope, windage, and speed of the green.

The symmetry of the club 11 is appreciated as making the club 11 useful to right and left handed players and the handle structure accommodates a wide spectrum of personal putting styles.

Having thus described my invention, those skilled in the art will readily perceive improvements, modifications and changes and such improvements, modifications and changes, within the skill of the art, are intended to be included in the spirit of the present invention limited only by the scope of my hereinafter appended claims.

I claim:

1. A golf club of the putter type having a club head with at least one face symmetrical on either side of a vertical stem;

a bend in said stem above said face and in a plane parallel to said face;

a curved shoe flat on the bottom and in a plane transverse to the plane of said stem;

symmetrical truncations rising from said curved shoe and generally toward said stem in planes transverse to the plane of said face and forming two parallel lines on the top of said club head, said parallel lines spaced apart by a distance substantially equal to the diameter of a golf ball;

a shaft extending upwardly from said stem; and a handle connected to said shaft, said handle having a length in excess of one-half of the club length.

2. In the combination structure of claim 1 wherein said stem extends upwardly between a pair of symmetrical faces in parallel planes and the top of said club head being parallel to the bottom of said shoe and said top of said club head truncated symmetrically on each side of said vertical portion of said stem and forming parallel lines, one on each side of said stem in said top spaced-apart from each substantially the distance equal to the diameter of a golf ball whereby said parallel lines formed by said truncations form a ball flanking pair of line guides which, in use, are converged by the eye in extension to the center of the cup target.

3. In the combination of claim 2 wherein said handle extends upwardly and away from said vertical portion of said stem at an angle of between about one degree and about fifteen degrees from vertical.

4. In the combination of claim 3 wherein said handle is elongate and includes at least a pair of flatted surfaces, one on each side of said handle, fore and aft when said club head is resting flat on the earth.

5. In the combination of claim 1 wherein the bend in said vertical stem is between one degree and about fifteen degrees from vertical.

6. A golf club of the putter type and useful for left and right handed putting in conventional and modified croquet-like putting, the combination comprising:

a club head, said club head having a pair of parallel spaced-apart faces, a sole transverse of said faces and having rounded ends, truncations from said rounded ends in planes intersecting the upper surface of said club head and equally spaced on either side of the center of said club head defining parallel lines on the upper surface of said club head separated a distance substantially equal to the diameter of a golf ball;

a stem piece rising from the top of said club head at the center thereof;

a shaft connected to said stem piece and deviating from a transverse extension from said top of said club head at the center thereof at an angle between about 10 degrees and about 15 degrees in a plane parallel to and between the said parallel spaced-apart faces of said club head; and a handle having flats on the uppermost and lowermost sides thereof and connected axially over said shaft and extending for a length exceeding one-half of the total height of said club.

* * * * *

UNITED STATES PATENT AND TRADEMARK OFFICE

CERTIFICATE OF CORRECTION

PATENT NO. : 4,426,083

DATED : January 17, 1984

INVENTOR(S) : William C. Dishner, Jr.

It is certified that error appears in the above-identified patent and that said Letters Patent is hereby corrected as shown below:

Column 2, line 4, "place" should read --- plane ---

Signed and Sealed this

*Twentieth* Day of *March 1984*

[SEAL]

*Attest:*

GERALD J. MOSSINGHOFF

*Attesting Officer*

*Commissioner of Patents and Trademarks*